United States Patent [19]

Chandley

[11] Patent Number: 4,791,977

[45] Date of Patent: Dec. 20, 1988

[54] COUNTERGRAVITY METAL CASTING APPARATUS AND PROCESS

[75] Inventor: George D. Chandley, Amherst, N.H.

[73] Assignee: Metal Casting Technology, Inc., Milford, N.H.

[21] Appl. No.: 47,907

[22] Filed: May 7, 1987

[51] Int. Cl.[4] ..... B22D 18/06

[52] U.S. Cl. ..... 164/63; 164/66.1; 164/119; 164/255; 164/259; 164/306

[58] Field of Search ..... 164/63, 66.1, 119, 255, 164/259, 306, 307

[56] References Cited

U.S. PATENT DOCUMENTS

| | | | |
|---|---|---|---|
| 2,923,040 | 2/1960 | Goodwin et al. . | |
| 3,818,974 | 6/1974 | Eberle | 164/255 |
| 3,900,064 | 8/1975 | Chandley et al. . | |
| 4,340,108 | 7/1982 | Chandley et al. | 164/63 |
| 4,532,976 | 8/1985 | Chandley et al. | 164/363 |
| 4,589,466 | 5/1986 | Chandley et al. | 164/119 |

*Primary Examiner*—Kuang Y. Lin

[57] ABSTRACT

An apparatus and method for counter-gravity casting of molten metal, in a gas permeable mold with a fill passage upper end above the lateral communication of the passage with other mold cavities. The mold is filled by low pressure in a chamber sealed about the mold while the mold fill passage is communicated with the molten metal. Provision is made for maintaining, during filling, the upper part of the mold fill passage at a lower pressure than that in the chamber external to the mold.

11 Claims, 3 Drawing Sheets

COUNTERGRAVITY METAL CASTING APPARATUS AND PROCESS

This application is related to an application of the same inventor filed simultaneously herewith, Ser. No. 47,334, filed May 7, 1987, now abandoned.

BACKGROUND OF THE INVENTION

This invention relates to apparatus and methods of countergravity casting of molten metal. More particularly, the invention concerns such casting in which the molten metal is caused to flow into and fill the cavities of gas-pervious molds by low pressure induced in a vacuum chamber sealed around them.

Prior art apparatus and methods of the type concerned set forth in U.S. Pat. Nos. 3,900,064 and 4,589,466 have been successful in producing high quality castings, superior in many respects to castings produced by pouring methods dependant on gravity-induced flow. The vacuum chamber is usually maintained at a pressure at least as low as about ⅓ (5 p.s.i.) below atmospheric pressure while the molten metal is essentially at atmospheric pressure and, to fill thin molding cavities, often as low as 13 p.s.i. below atmospheric pressure.

Also, after the mold is filled, the metallostatic pressure in the lower part of the mold is additive to the vacuum pressure, so the total metal pressure in that volume often reaches 18 psi. These metal pressures generate stresses in the mold walls depending on the shape of the mold cavity and its size. The size of these stresses increases as the parts overall dimensions increase. For example, a part 2"×4"×¼" could have a force of 144 lbs. to contain while a part 6"×4"×¼" would have a force of 432 lbs. to contain. Such high forces when combined with the high temperatures of steels especially, can cause mold wall movement, metal penetration into the mold face, and even outright mold failure especially if there are any structural defects in the molds. The practical effect is that costly measures may be required to avoid these problems and certain larger shapes cannot be made by the methods taught. Also, the methods require molds of high strength and inside faces of low porosity, such as high temperature bonded ceramic shell molds. Lower strength molds, such as low temperature bonded sand molds, have been filled primarily by other methods, such as the partial immersion of the mold in the molten metal with vacuum applied only to the upper part of the mold, in accordance with U.S. Pat. Nos. 4,340,108 and 4,532,976.

SUMMARY OF THE INVENTION

It has been discovered that aforesaid difficulties are avoided or minimized, and other advantages ensue, by providing, in the gas-pervious mold, a fill passage which communicates with other cavities of the mold and by maintaining the upper part of this passage at a lower pressure than the pressure in the vacuum chamber surrounding the mold.

The apparatus of the invention includes, as in the prior art, a gas-permeable mold having cavity means therein, including a fill passage communicating laterally with other cavity means of the mold, the fill passage having a lower open end and an upper end above its uppermost lateral communication with other cavity means; a sealable mold support chamber for the mold; means for communicating the lower open end of the fill passage of a mold sealed in the chamber with a body of molten metal to be cast; and pressure reducing means for producing in the sealed chamber pressure sufficiently lower than the pressure on the molten metal to cause the molten metal to flow through the communicating means and fill passage to fill the other cavity means of the mold. However, according to the invention, the pressure reducing means includes differential pressure reducing means for selectively maintaining, during filling of the mold, the upper part of the fill passage at a lower reduced pressure than the reduced pressure in the support chamber external to the mold.

In the method according to the invention the differential pressure reducing means is used to provide, in the upper end of the fill passage, a first pressure sufficiently lower than the pressure on the supply of molten metal to cause the molten metal to fill the passage and maintain it full; and simultaneously to provide in the chamber externally of the mold a second pressure, higher than the first pressure, and sufficiently lower than the pressure on the supply of molten metal to insure fill out of the other cavity means by molten metal flowing thereto from the fill passage. Preferably, the second pressure is raised after fill out of the cavity means, while the first pressure is maintained in the upper end of the fill passage and molten metal remains flowable in the fill passage and other cavity means.

In preferred apparatus, the differential pressure reducing means has a conduit with an open end in the chamber, the mold has a gas permeable closure for the upper end of the fill passage and means are provided for sealing the open end of the conduit to the mold about the fill passage upper end; the closure is a plug inserted in the top of the fill passage; and the top of the fill passage is above the other cavity means of the mold and/or the open end of the conduit is sealed about a larger area of the upper part of the mold including the top of the fill passage, to assist the filling of upwardly extending parts of other mold cavities beneath it.

The dual, independent control of low pressure inside and outside the mold provided by the invention enables fill out of casting cavities at lower total metal pressures against the inside of the casting cavities, reducing the potential for mold breakage and mold wall penetration by the metal and resulting in castings of superior finish and dimensional control. When used with low temperature bonded sand molds, it permits taller molds with more casting cavities, which may be formed of stacked sections bolted together, with substantial savings in cost of mold production as compared with prior apparatus and methods. Molds of large horizontal cross-section can be used with smaller diameter metal melts than before.

DESCRIPTION OF THE PREFERRED EMBODIMENTS

Figure 1:
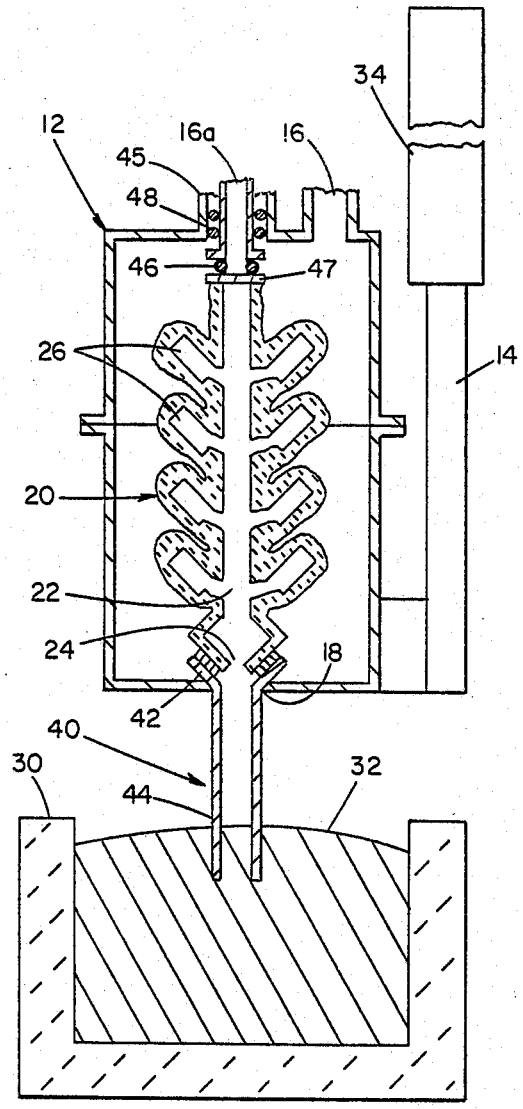
FIG. 1 is a schematic sectional side view of apparatus according to the invention in a relative position of parts for the application of vacuum to fill the mold.

Referring first to FIG. 1 of the drawings, there is provided a partable sealable loading chamber 12 mounted on a support 14 which is vertically movable and may preferably also be laterally movable. Loading chamber 12 has, in its upper wall, a connection 16 to a differential pressure apparatus (not shown) and in its lower mold supporting wall, a central opening 18 for supporting a gas permeable mold, generally designated 20, having a vertical fill passage 22 with a lower end 24 for introducing molten metal into mold cavities 26 therein. In FIG. 1, mold 20 is shown as a shell-type, high temperature bonded mold.

Casting with the apparatus and method of the invention can be utilized whether or not the casting metal is reactive with oxygen and/or nitrogen of air at casting temperatures. With reactive metals, the casting is performed with exclusion of air from the casting metal during all times that it is above a temperature at which it is significantly reactive with air, preferably in accordance with the teachings of aforesaid U.S. patent application Ser. No. 47,334.

A crucible 30 for molding molten metal, providing an exposed molten metal upper surface 32, is positioned beneath chamber 12. It will be understood that the crucible is surrounded by the usual induction heating coil (not shown) embedded in electrical insulation (not shown). A hollow fill pipe, designated generally 40, extends downwardly from chamber 12 toward crucible 30. This fill pipe may be an integral part of the mold, but is shown as a separate pipe, having an upper flange 42 which is seated about the bottom opening 24 of the mold and sealingly fits, at it neck, the opening 18 in chamber 12. A hydraulic power cylinder, partially shown at 34, connected to movable support 14 is provided for relatively moving crucible 30 and chamber 12 with mold 20 toward and away from one another by selectively raising or lowering chamber 12 with mold 20. (This is preferred, but the crucible can be movable instead or also.)

Figure 2:
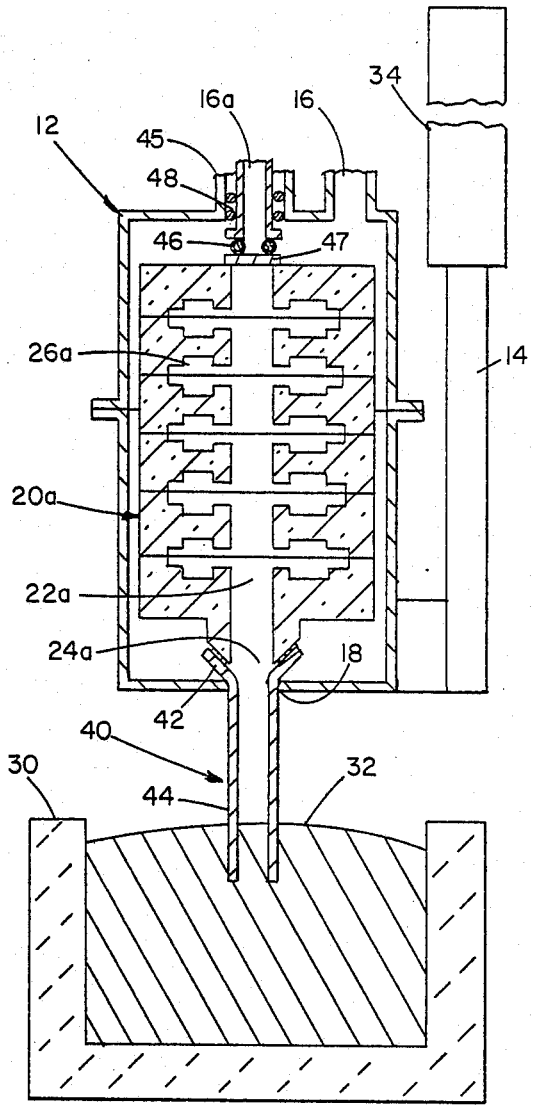
FIG. 2 is a similar view of the apparatus utilizing a different mold.
Figure 3:
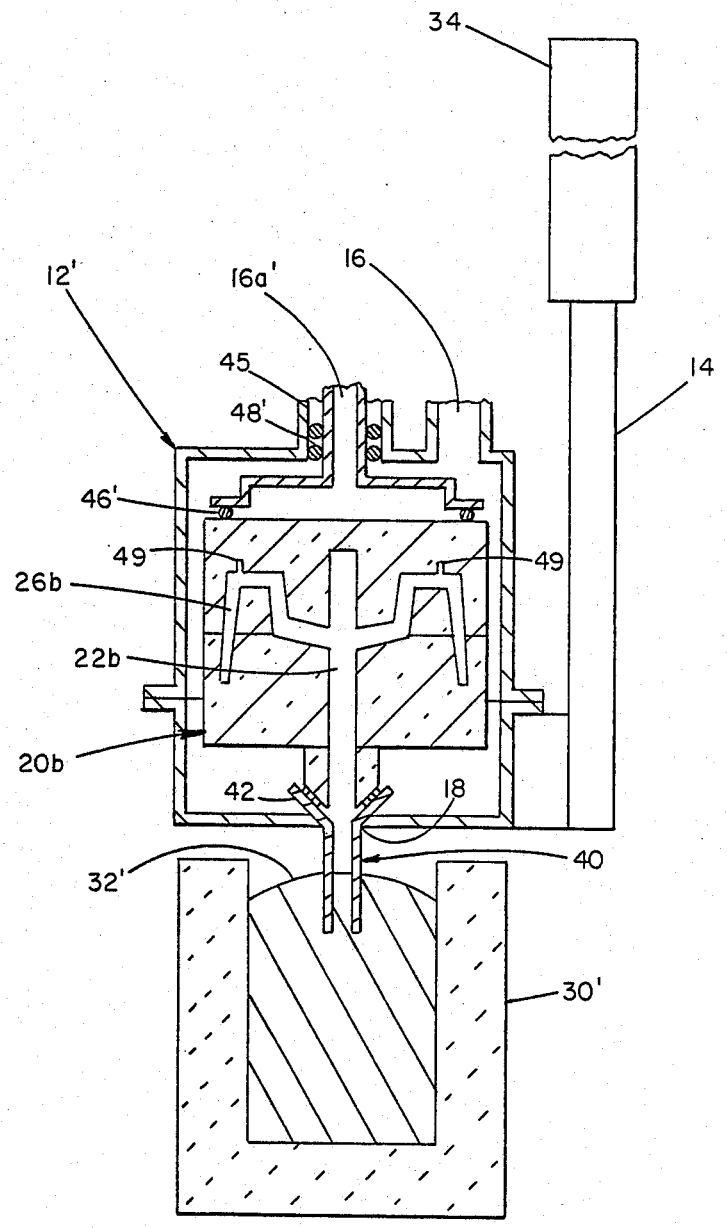
FIG. 3 is a view like FIG. 2 of modified apparatus utilizing a different mold.

In a casting operation, the chamber 12 is moved from a position with fill pipe 40 spaced above the crucible to the fill position, shown in FIGS. 1 to 3, in which the open lower end of lower portion 44 of fill pipe 40 is immersed in the molten metal in the crucible. In this fill position, differential pressure apparatus 16 can be operated to apply a differential pressure to chamber 12, and to the outside of mold 20, sufficiently below the pressure on the molten metal in the crucible 30, to cause molten metal to flow through fill pipe 40 into fill passage 22 of the mold, filling the communicating mold cavities 26.

As so far described, the apparatus of FIG. 1 is substantially as disclosed in U.S. Pat. No. 4,589,466, as is preferred. While not shown in the drawings hereof, the device shown in that patent for crimping closed a metal fill pipe, corresponding to the fill pipe 40 of FIG. 1 of the present application, after the mold has been filled, may be used in conjunction with the apparatus of this invention, as desired.

According to the present invention, there is provided in a duct 45 in the upper wall of chamber 12 a second connection **16*a* to a differential pressure apparatus (not shown) which can be selectively operated to provide a lower pressure than is simultaneously provided in chamber 12 through connection 16. Connections 16*a* and 16 may be to different vacuum pumping systems or to a single such system equipped with suitable valve controls for providing different pressures in the two connections. A porous plug 47, highly permeable to gas but not to metal, fills an opening at the upper end of fill passage 22 of the mold, and connection 16*a* is mounted with its mouth exposed to the outer surface of plug 47. Such system or systems will usually be fixedly mounted with flexible connections to it permitting the motions of chamber 12. A pressure seal 46, which may be of the O-ring type, is provided between connection 16*a* and the mold top so that the upper end of the fill passage can be maintained at differential pressure to that in chamber 12. Similar seals 48 are provided between connection 16*a* and conduit 45 to prevent leakage from chamber 12**.

The opening with porous plug 47 is preferred structure because the mold above the fill passage does not have to stand the weight of metal in the filled mold. It can thus generally be made more porous than it is safe to make the rest of the mold body.

In operation, first the lower portion 44 of fill pipe 40 is inserted through the lower opening 18 of open chamber 12, so that its flanged upper portion 42 is supported by the lower wall of chamber 12 and its lower end portion 44 extends vertically downwardly toward crucible 30, spaced above the surface 32 of the molten metal in crucible 30. Next, mold 20 is placed on the upper surface of flared fill pipe portion 42 with its lower open end 24 concentric with fill pipe 40 so that fill pipe 40 is removably sealingly connected between the lower open end 24 of vertical mold passage 22 and the lower wall of chamber 12 surrounding chamber lower opening 18. Porous plug 47 is inserted and connection **16*a* is placed in sealed communication with it. These operations are conveniently performed with the chamber 12** moved laterally away from the crucible furnace.

Thereafter, with the chamber 12 returned to position over the crucible, when the casting is to be conducted without exclusion of air, chamber 12 with mold 20 and fill pipe 40 is moved downwardly by operating hydraulic power cylinder 34 to move the lower end of fill pipe 40 to the fill position shown in FIGS. 1–3, in which the lower, free end of the fill pipe is immersed in the molten metal in the crucible. A reduced differential pressure is then applied to the interior of mold 20 through vertical passage 22 by operating connection **16*a* to cause molten metal to flow up fill pipe 40 and fill vertical passage 22, the metallostatic head in vertical passage 22 also causing lateral flow into mold cavities 20. Simultaneously, a second pressure higher than the pressure applied through connection 16*a*, but lower than the pressure on the molten metal in crucible 30, is applied to chamber 12, and so to the exterior of mold 20, through connection 16 to insure that mold cavities 26 fill with molten metal. The magnitude of this second pressure is just adequate to cause mold cavities 26 to fill. Once filling is complete, the pressure surrounding mold 20** may be increased, while maintaining the low pressure in the mold interior, to improve part quality and reduce tensile stresses in the mold.

Once molding is complete, the pressure in the interior and on the exterior of mold 20 is restored to atmospheric pressure. Compartment 12 is then opened, and the filled mold 20 and fill pipe 40 are removed and separated in preparation for another molding cycle.

The extent of the differential pressure maintained between the upper part of fill passage 22 of the mold and in chamber 12 is to some extent a variable, depending largely on the characteristics of the particular mold employed. This is to say that a mold with cavities easy to fill from the metallostatic head in the mold fill passage 22 would permit greater differentials than those harder to fill out in this way, the latter including molds having very thin molding cavity portions, particularly if they have to be disposed upwardly of their gate communication with mold fill passage 22. Even with such hard to fill molds, chamber 12 can usually be maintained during fill at a pressure at least 5 inches Hg. higher than the pressure maintained through connection 16*a;* considerably larger differentials will assure adequate fill out of easy to fill molds. The advantages in thus relieving the internal relative pressure load on the mold cavity walls are substantial, as stated above.

In FIG. 1 the mold 20 is a high temperature bonded ceramic mold whereas in FIG. 2 the mold 20*a* is a low temperature bonded sand mold formed in horizontal sections secured together. Parts of the mold 20*b* corresponding to those of mold 20 of FIG. 1 are designated by the same reference numerals with the subscript *a*. Because of the advantages of the invention, the molds of these Figures may be taller, with more productive capacity, than before or may have superior qualities for the same capacity, or both. Actually, because of the relative weakness of the mold 20*a* of FIG. 2, the invention makes the mold structure of the Figure possible, as without the higher pressure in chamber 12, the relative pressure on the mold interior would be so high as to be likely to break the mold.

FIG. 3 shows a modification of the structure shown in FIGS. 1 and 2 used with a different mold 20*b* of the low temperature bonded sand type, used for molding a large part or parts. In FIG. 3, mold parts are designated by the subscript *b* to reference numerals of mold 20 to which they correspond, while other modifications are indicated by primes of the same reference numerals of FIG. 1.

Mold 20*b* is of extraordinarily large size and filling complexity for a low temperature bonded sand mold, being made in two superposed halves sealed together. The fill passage 22*b* of the mold could form a shaft of a single part or the branching cavities 26*b* could form separate parts. The mold is an example of one particularly difficult to fill out because, not only do the branching cavities 26*b* lie in substantial part above their gate connection to the fill passage but they have thin fins 49 upstanding above the gate connection.

In cases such as presented by mold 22*b*, connection 16*a'* may be modified as shown by enlarging the diameter of its mouth so that it covers not only fill passage 22*b* of the mold but also the hard-to-fill cavity portions, its enlarged seal 46' being beyond their extremities. In this case, the opening at the top of fill passage 22 of the mold 20 of FIG. 1, and its plug 47, may be omitted. Thus, the lower pressure in connection 16*a'* is communicated through the top of the mold to the hard-to-fill parts as well as to the top of the fill passage, and abnormally low differential pressure need not be maintained in chamber 12' to insure fill out.

In contrast with the bottom-dipped molds of the prior art, with the apparatus and process of this invention the molds may be larger than the crucible, extending beyond the confines of the exposed metal surface in the crucible, as does the mold 20*b* of FIG. 3. Thus, the ability to process abnormally large molds by this invention is not hampered by any need for abnormally large furnaces to provide correspondingly enlarged molten metal exposure.

Many molding metals are reactive at temperatures suitable for casting with oxygen and/or nitrogen of air to form by-products harmful to the casting. Hence, such metals are commonly cast with exclusion of air from the molten casting metal while at reactive temperature. While the prior art discloses various apparatus and methods for such air exclusion, it is preferred to use for the purpose the apparatus and method of aforesaid related U.S. application Ser. No. 47,334, the disclosure whereof, so far as not expressly incorporated herein, is incorporated by reference.

Figure 4:
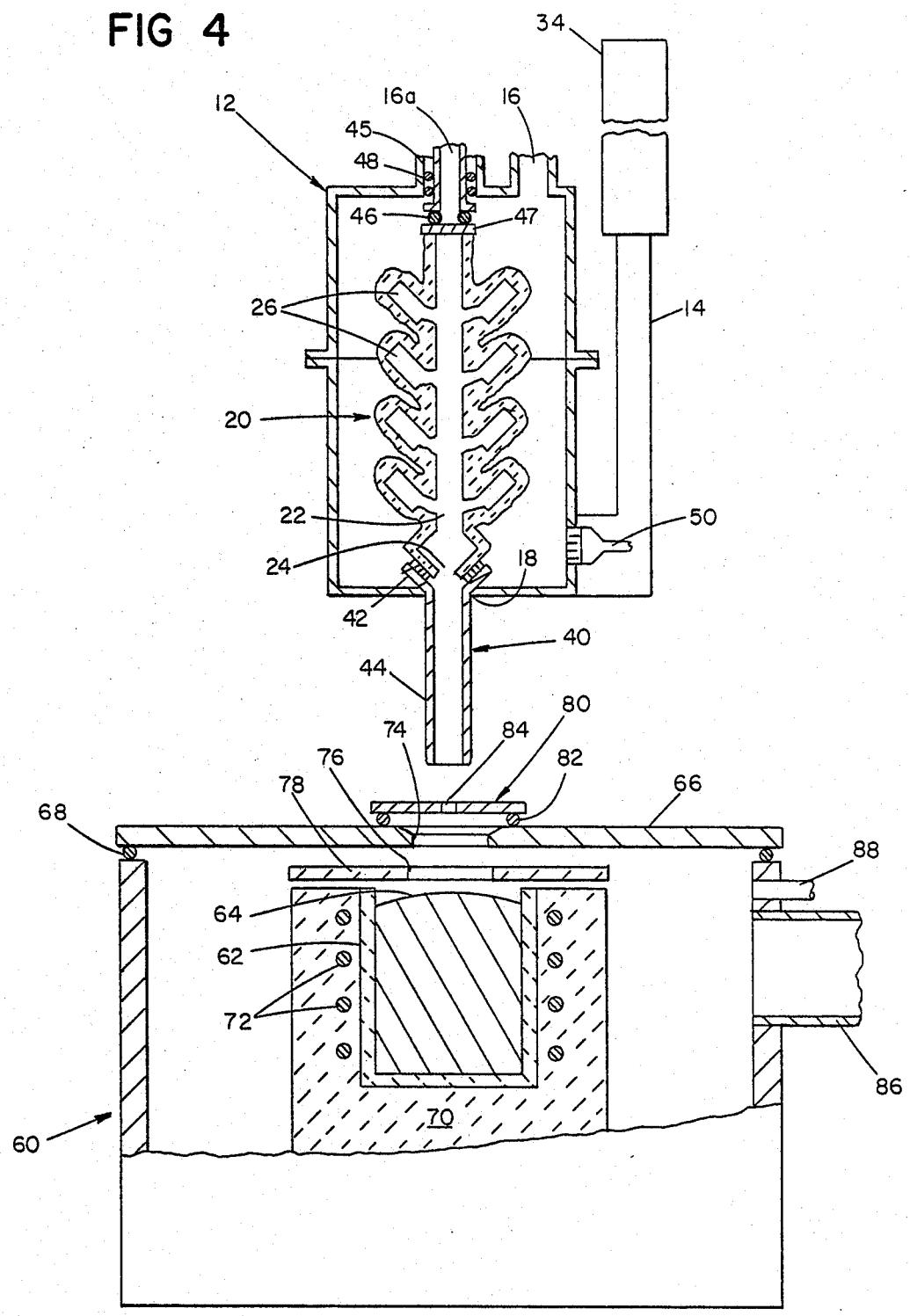
FIG. 4 is a schematic sectional side view, partly in side elevation of an enclosed crucible suitable for casting with exclusion of air, utilizing methods of the present application and of the aforesaid co-pending application.

FIG. 4 of he present application illustrates apparatus of the related application for casting with exclusion of air, associated with the apparatus of FIG. 1 (which could be equally FIG. 2 or FIG. 3). The only change from FIG. 1, which retains its same reference numerals, is the addition of a connection 50 to a source of inert gas (not shown) for selectively discharging such gas into chamber 12, externally of mold 20.

The apparatus of FIG. 4 provides in addition a generally box-like enclosure, designated generally 60, for the crucible, here designated 62, of molten metal, having an upper surface 64. Enclosure 60 may rest on the floor and may have its top wall 66 removably seated on the tops of the side walls by an O-ring seal 68 (for full access to the interior). The inside of the walls of enclosure 60 may be provided with a coil or coils (not shown) for the circulation of cooling fluid such as water or double walls may be provided, spaced apart to permit circulation of coolant between them. Crucible 62 is embedded in a block of refractory electrical insulation 70, containing induction heating coil 72 surrounding the crucible, which may rest on a support means (not shown).

An opening 74 is provided in the top wall 66 of enclosure 60, centrally of molten metal surface 64 of crucible 62, this opening being of a size to receive freely therethrough the lower end 44 of fill pipe 40 of the apparatus of the other Figures. A like opening 76 is provided in the usual heat shield 78 of insulating material which is supported above the crucible on the top of block 70. A removable cover 80 for opening 74 is sealed to top wall 66 of the enclosure about opening 74 by O-ring seal 82. A small opening 84 may be provided centrally of cover 80 through which a thermocouple may be inserted in the melt to measure its temperature. Enclosure 60 has a connection 86 to a differential pressure apparatus capable of evacuating crucible enclosure 60 to a high vacuum when the enclosure is sealed. A connection 88 is also provided to a source of inert gas (not shown).

In use of the apparatus of FIG. 4, a supply of molten metal is provided in crucible 62 under a substantially air-free atmosphere of inert gas (in a manner hereinafter described). Cover 80 is removed before the casting operation commences, entrance of air into the crucible enclosure through opening 74 being prevented by maintaining a flow of the inert gas above atmospheric pressure. With an inert gas such as argon, several times as dense as air, or nitrogen, with a density only fractionally lower than air, the gas flow may be easily controlled to prevent entry of air into enclosure 60 through opening 74.

In the process of casting with the apparatus of FIG. 4, instead of inserting fill pipe 40 directly below the melt surface and then evacuating the chamber 12, the chamber 12 is moved in a two-stage operation. The first stage injects the fill pipe end 44 through opening 74 and stops the relative motion when the pipe end is immersed in the inert gas atmosphere above the surface 64 of the molten metal in the crucible. During a dwell in this position, the chamber 12 is evacuated only to the low vacuum required to cause inert gas in the crucible enclosure 60 to flow through the fill pipe 40, mold 20 and chamber 12, purging them of air. During this stage, connection 50 in chamber 12 is preferably operated to admit additional inert gas to aid in flushing the chamber. Also connection 16*a* is preferably operated to provide a somewhat lower pressure to the mold than is provided in the connection 16 to the chamber 12.

After a short dwell for the purpose stated, which may require only about 15 seconds, the movement of chamber 12 is resumed to immerse the fill pipe end in the molten metal below its surface, the fill position. In this position the chamber 12 and mold are further evacuated to the higher vacuum required to fill the mold, connection 16*a* often being operated to provide a lower pressure to the mold than the pressure provided in chamber 12 by connection 16, as described in connection with FIGS. 1 to 3. As soon as the metal has hardened sufficiently in the mold, chamber 12 is reversely moved to withdraw pipe 40 through openings 76 and 74, so that cover 80 may be replaced over opening 74. The pressure will be raised in the chamber by the admission of inert gas through connection 50 so long as the casting metal remains at reactive temperatures. The remaining operations may be as described in connection with FIGS. 1 to 3.

For initially supplying metal to the crucible under an air-free inert gas atmosphere, which needs to be done only occasionally, a replacement cover (not shown) for cover 80 is provided which is impervious, larger and stronger than the cover 80 and capable of withstanding the evacuation of crucible enclosure 60 to high vacuum. With cover 80 removed, metal to be melted is placed in the crucible through opening 74, and this replacement cover is removably sealed to top wall 66 of the enclosure cover opening 74. The enclosure is evacuated through connection 86 to a substantially air-free condition, and induction coil 72 is operated to melt the metal. When the melt has reached the desired temperature, the inert gas to the desired pressure is admitted to the enclosure through connection 88 and the replacement cover is removed and cover 80 is reapplied.

The flushing with inert gas induced by low pressure applied both externally and internally of the mold has been found more effective than conventional processes flushing the mold only from its exterior.

I claim:

1. A method of counter-gravity casting molten metal in a mold of gas permeable material contained in a sealed chamber and having a fill passage therein communicating laterally below its upper end with cavity means of said mold, comprising the steps of:

communicating a lower portion of said fill passage with a supply of molten metal to be cast;

providing in the upper end of said fill passage a first pressure sufficiently lower than the pressure on said supply of molten metal to cause the molten metal to fill said passage and maintain it full; and simultaneously providing in said chamber externally of said mold a second pressure higher than said first pressure and sufficiently lower than the pressure on said supply of molten metal to insure fillout of said other cavity means by molten metal flowing thereto from said fill passage.

2. A method according to claim 1 which includes the further step of raising said second pressure after fillout of said cavity means by said molten metal while said first pressure is maintained in the upper end of said fill passage and molten metal remains flowable in said fill passage and other cavity means.

3. A method according to either of claims 1 or 2 wherein said first pressure is produced by connecting the mold outer surface above the upper end of the fill passage to a source of such pressure.

4. A method according to either of claims 1 or 2 wherein said first and second pressures are of a gas other than air with which the molten metal is non-reactive.

5. In apparatus for counter-gravity casting of molten metal comprising:

a mold of gas-permeable material having cavity means therein including a fill passage communicating laterally with other cavity means of said mold, said fill passage having a lower open end and an upper end above its uppermost communication with said other cavity means;

a sealable mold support chamber for said mold;

means for communicating the open lower end of the fill passage of a said mold sealed in said chamber with a body of molten metal to be cast;

and pressure reducing means for producing in said sealed chamber pressure sufficiently lower than the pressure on said molten metal to cause said molten metal to flow through said communicating means and said fill passage to fill said other mold cavity means;

the improvement wherein said pressure reducing means includes differential pressure reducing means for selectively maintaining during filling of said mold, the upper part of said mold fill passage at a lower reduced pressure than the reduced pressure in said support chamber external to the mold.

6. Apparatus according to claim 5 wherein said differential pressure reducing means includes conduit means extending from said pressure reducing means to an open end of said conduit in said chamber, and means for removably sealing said open end of said conduit means to the surface of said mold over the upper end of said fill passage.

7. Apparatus according to claim 6 wherein said mold has an opening therethrough above said fill passage which is closed by a plug which is permeable to gas but not by the molten metal, and the open end of said conduit means is sealed about the top of said plug.

8. Apparatus according to claim 7 in which said plug is more permeable to gas than the mold body surrounding it.

9. Apparatus according to claim 6 wherein the open end of said conduit means is larger than the upper end of said fill passage so that when sealed thereover it also overlies portions of cavity means other than said fill passage.

10. Apparatus according to any one of claims 5 to 5 wherein the top of said fill passage is above said other mold cavity means.

11. Apparatus according to any of claims 5 to 9 which includes means for supplying to said chamber externally of said mold gas other tan air with which the molten metal is non-reactive.

* * * * *

UNITED STATES PATENT AND TRADEMARK OFFICE

CERTIFICATE OF CORRECTION

PATENT NO. : 4,791,977

DATED : December 20, 1988

INVENTOR(S) : George D. Chandley

It is certified that error appears in the above-identified patent and that said Letters Patent is hereby corrected as shown below:

Column 1, Line 33, "parts" should be -- part's --.

Column 3, Line 35, "it" should be -- its --.

Column 5, Line 19, "20b" should be -- 20a --.

Column 7, Line 5 of Claim 1, after "said mold" insert -- other than said fill passage --.

Column 8, Line 1 of Claim 10, "claims 5 to 5" should be -- claims 5 to 9 --.

Signed and Sealed this

Sixteenth Day of May, 1989

*Attest:*

*Attesting Officer*

DONALD J. QUIGG

*Commissioner of Patents and Trademarks*